US007943689B2

(12) United States Patent
Shiga et al.

(10) Patent No.: US 7,943,689 B2
(45) Date of Patent: May 17, 2011

(54) GOLF BALL AND PROCESS FOR PREPARING THE SAME

(75) Inventors: Kazuyoshi Shiga, Kobe (JP); Takeshi Asakura, Kobe (JP); Mikio Yamada, Kobe (JP); Sung Chul Kim, Daejeon (KR); Jae Soon Lee, Daejeon (KR)

(73) Assignees: SRI Sports Limited, Kobe (JP); Korea Advanced Institute of Science of Technology, Yuseong-Gu (KR)

( * ) Notice: Subject to any disclaimer, the term of this patent is extended or adjusted under 35 U.S.C. 154(b) by 422 days.

(21) Appl. No.: 12/153,682

(22) Filed: May 22, 2008

(65) Prior Publication Data

US 2008/0293518 A1 Nov. 27, 2008

(30) Foreign Application Priority Data

May 24, 2007 (JP) ..... 2007-138441

(51) Int. Cl.

| | |
|---|---|
| ***A63B 37/12*** | (2006.01) |
| ***A63B 37/00*** | (2006.01) |
| ***C08K 3/34*** | (2006.01) |
| ***C08L 75/12*** | (2006.01) |

(52) U.S. Cl. ..... 524/445; 524/444; 524/447; 524/449; 524/789; 524/791; 524/839; 524/840; 473/378; 473/385

(58) Field of Classification Search ..... None
See application file for complete search history.

(56) References Cited

U.S. PATENT DOCUMENTS

| | | | | |
|---|---|---|---|---|
| 5,692,974 | A * | 12/1997 | Wu et al. | 473/377 |
| 5,851,245 | A * | 12/1998 | Moriyama et al. | 44/301 |
| 6,688,992 | B2 | 2/2004 | Takemura et al. | |
| 7,332,533 | B2 | 2/2008 | Kim et al. | |
| 2005/0059756 | A1 * | 3/2005 | Kim et al. | 523/220 |
| 2006/0009308 | A1 * | 1/2006 | Isogawa et al. | 473/371 |

FOREIGN PATENT DOCUMENTS

| | | | |
|---|---|---|---|
| JP | 10-168305 | A | 6/1998 |
| JP | 2002-136618 | A | 5/2002 |
| JP | 2002-539905 | A | 11/2002 |
| JP | 2003-511116 | A | 3/2003 |
| JP | 2004-504900 | A | 2/2004 |
| JP | 2005-28153 | A | 2/2005 |
| JP | 2006-43447 | A | 2/2006 |
| JP | 2006-346015 | A | 12/2006 |
| KR | 20050112693 | A | 12/2005 |
| WO | WO-00/57962 | A1 | 10/2000 |
| WO | WO-01/24888 | A1 | 4/2001 |

OTHER PUBLICATIONS

Choi, Synthesis of Chain-extended Organifier and Properties of Polyurethane/Clay Nanocompsites, Polymer 45; Jun. 2004; pp. 6045-6057.*

Nanocor product literature for Lit. N-609; no date.*

* cited by examiner

*Primary Examiner* — David Buttner

(74) *Attorney, Agent, or Firm* — Birch, Stewart, Kolasch & Birch, LLP

(57) ABSTRACT

An object of the present invention is to improve abrasion-resistance and spin performance of a golf ball having a polyurethane cover.

The golf ball of the present invention is a golf ball having a core and a cover covering the core. The cover contains a layered silicate and a polyurethane resin having a secondary or a tertiary amine structure in a molecular chain thereof. In the present invention, the polyurethane resin used as a resin component constituting the cover has a secondary or tertiary amine structure in a molecular chain. Thus, it has a strong interaction with the layered silicate, and a reinforcing effect of the filler becomes even higher. As a result, abrasion-resistance and spin performance of the resultant cover are improved.

19 Claims, 1 Drawing Sheet

GOLF BALL AND PROCESS FOR PREPARING THE SAME

BACKGROUND OF THE INVENTION

1. Field of the Invention

The present invention relates to a golf ball having a polyurethane cover and a method for preparing the same, more specifically to technology for improving abrasion-resistance and controllability.

2. Description of the Related Art

As the base resin constituting the cover of the golf ball, an ionomer resin and a polyurethane resin are used. The cover using the ionomer resin is widely used because -they are excellent in resilience, durability, workability and the like. There have been pointed out problems of poor shot feeling, insufficient spin performance, and inferior controllability since the ionomer resin cover has high rigidity and hardness. On the other hand, a polyurethane resin is used as a base resin constituting a cover because it provides improved shot feeling and spin performance compared with the ionomer resin. In recent years, however, accompanied with reduction of a thickness of a golf ball cover (thinner cover) and improvement of golf clubs (higher repulsion, lower spin, and change in groove configuration of face), there has been a demand for further improving cover performance of a golf ball, because abrasion-resistance and spin performance of a cover using a conventional polyurethane resin are no longer at a satisfactory level. In view of such circumstances, for example, Japanese patent publication Nos. 2002-136618A, 2002-539905A, 2003-511116A, 2006-43447A and 2004-504900A propose improving cover properties by blending a filler such as an organic short fiber, a glass, a metal, and a clay mineral in a base resin constituting a cover. Additionally, technology for improving a mechanical property of polyurethane is disclosed in, for example, Japanese patent publication No. H10-168305A and Korean patent publication No. 2005-0112693.

SUMMARY OF THE INVENTION

The present invention has been achieved in view of the above circumstances. The object of the present invention is to improve abrasion-resistance and spin performance of a golf ball having a polyurethane cover.

The golf ball of the present invention that has solved the above problem is a golf ball comprising a core and a cover covering the core, wherein the cover comprises a polyurethane resin having a secondary or tertiary amine structure in a molecular chain thereof and a layered silicate. In the present invention, since the polyurethane resin used as the resin component constituting the cover has a secondary or tertiary amine structure in a molecular chain, the polyurethane has a strong interaction with a layered silicate to be used as a filler, thereby further enhancing a reinforcing effect of the filler. As a result, abrasion-resistance and spin performance of the resultant cover are improved. As the interaction of the polyurethane resin having a secondary or tertiary amine structure in a molecular chain with the layered silicate, for example, there is an embodiment wherein the secondary or tertiary amine structure is cationized and bonded to the layered silicate via electrostatic interaction.

The cover of the golf ball of the present invention is preferably formed from a cover composition containing a polyisocyanate, a polyol and a polyol-layered silicate composite treated with a polyol having a secondary or tertiary amine structure in a molecule thereof. Herein, the "polyol-layered silicate composite treated with the polyol having a secondary or tertiary amine structure in a molecule thereof" is a layered silicate wherein the secondary or tertiary amine structure of the polyol is cationized, and the cationized polyol is intercalated between layers of the layered silicate and bonded to the layered silicate via an electrostatic interaction. Namely, in the above preferred embodiment, a cationized polyol having a relatively low-molecular weight intercalated between layers of the layered silicate is allowed to react with a polyisocyanate and a polyol to be polymerized, thereby facilitating the intercalation of the cationized polyurethane resin between the layers of the layered silicate.

As the polyol-layered silicate composite treated with the polyol having the secondary or tertiary amine structure, a urethane polyol-layered silicate composite treated with a urethane polyol having a secondary or tertiary amine structure in a molecule thereof is preferably used. The composite with a urethane polyol having a relatively large molecular weight increases a distance between the layers of the layered silicate. As a result, the urethane polyol present between the layers of the layered silicate readily reacts with a polyisocyanate.

The present invention includes a method for preparing a golf ball comprising the steps of cationizing a polyol having a secondary or tertiary amine structure in a molecule thereof, dispersing a layered silicate into the cationized polyol to obtain a polyol-layered silicate composite, mixing the polyol-layered silicate composite, a polyol, and a polyisocyanate to prepare a cover composition, and molding a cover from the cover composition.

The present invention provides a golf ball having high abrasion-resistance and spin performance.

DESCRIPTION OF THE PREFERRED EMBODIMENT

Figure 1:
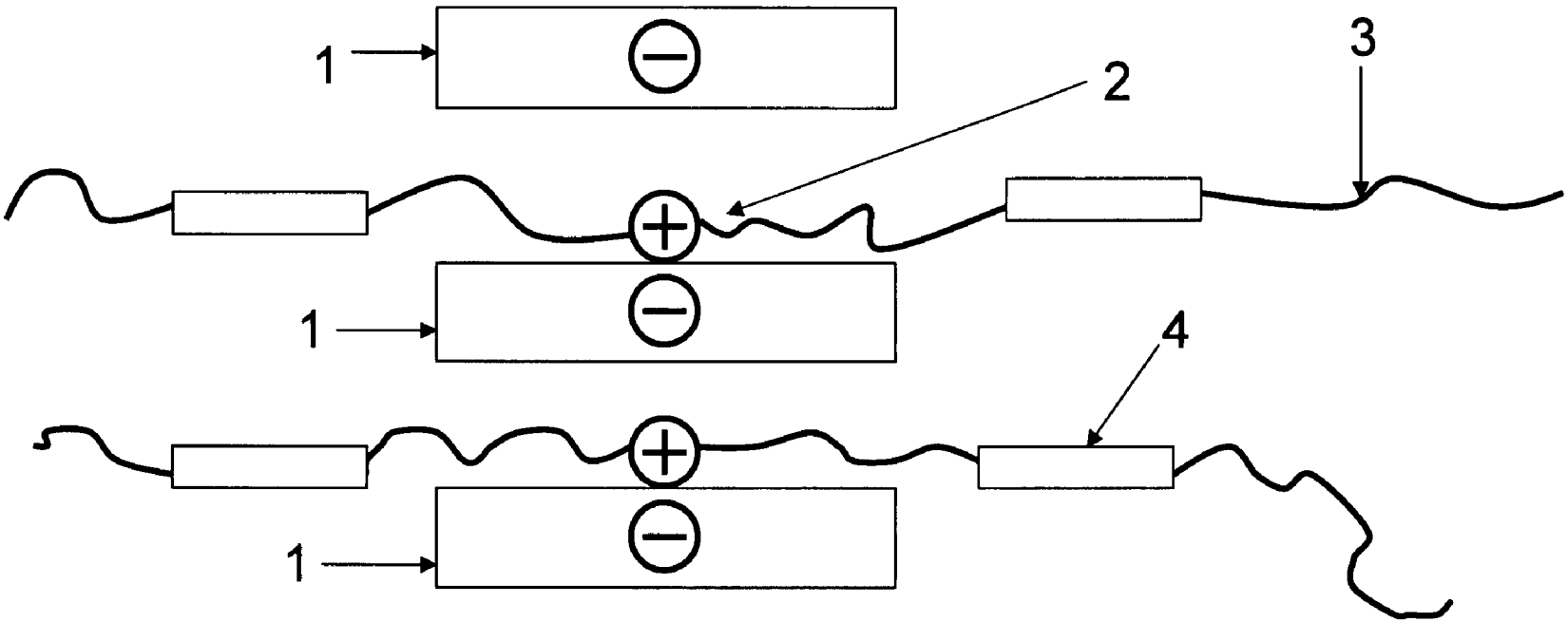
FIG. 1 is an explanatory illustration showing an interaction between the layered silicate and the polyurethane resin having the tertiary amine structure in the molecular chain.

The present invention provides a golf ball comprising a core and a cover covering the core, wherein the cover comprises a polyurethane resin having a secondary or tertiary amine structure in a molecular chain and a layered silicate.

(1) Interaction Between the Layered Silicate and the Polyurethane Resin having Secondary or Tertiary Amine Structure in a Molecular Chain In the present invention, the polyurethane resin used as the resin component constituting the cover has the secondary amine or tertiary amine structure in a molecular chain, and thus the polyurethane has a strong interaction with the layered silicate to be used as a filler, thereby obtaining an enhanced reinforcing effect of the filler on the resultant cover. A cation present between layers of the layered silicate is generally exchangeable with another cation (cation exchangeability). Taking an advantage of this property, another cationic material can be intercalated between layers of the layered silicate. FIG. 1 is an explanatory illustration showing an interaction between the layered silicate and the polyurethane resin having the tertiary amine structure in a molecular chain. As shown in FIG. 1, the polyurethane resin 3 having the tertiary amine structure 2 in the molecular chain thereof is cationized at the portion of the tertiary amine structure 2 and intercalated between layers of the layered silicate 1 and bonded to the layered silicate via electrostatic interaction.

In the present invention, since employing such a configuration provides the stronger interaction between the resin component constituting the cover and the filler, the reinforcing effect of the filler is enhanced. As a result, abrasion-resistance and spin performance of the resultant cover can be improved.

(2) Layered Silicate Used in the Present Invention

The "layered silicate" used in the present invention is a silicate having a layered structure. Examples of the layered silicate include, a layered silicate of kaolinite group such as kaolinite, dickite, halloysite, chrysotile, lizardite, amesite; a layered silicate of smectite group such as montmorillonite, beidellite, nontronite, saponite, iron saponite, hectorite, sauconite, stevensite; a vermiculite group such as dioctahedral vermiculite, and trioctahedral vermiculite; a layered silicate of mica group such as muscovite, paragonite, phlogopite, biotie, and lepidolite; a layered silicate of brittle mica group such as margarite, clintonite, and anandite; a layered silicate of chlorite group such as cookeite, sudoite, clinochlore, chamosite, and nimite, preferably, the layered silicate of smectite group such as the montmorillonite, the beidellite, the nontronite, the saponite, the iron saponite, the hectorite, the sauconite, and the stevensite; and the vermiculite group such as dioctahedral vermiculite, and trioctahedral vermiculite. It is because an expansion of an interlayer spacing and/or separation of layers are possible, and the layers have electrical charge.

An amount of the cation having exchangeability included in the layered silicate is referred to as cation exchange capacity (meq/g). The cation exchange capacity differs depending on the kind of clay, and even a same kind of clay has different cation exchange capacity if the source of origin differs. For example, a cation exchange capacity of hectorite is about 0.9 meq/g, while that of montmorillonite is about 1.3 meq/g.

The layered silicate is preferably a nano-size fine particle wherein a thickness of a primary particle is 10 nm or less, and preferably has a flat shape with a length and a width of 1 μm or less, respectively. A size of the layered silicate is not particularly limited, but it is preferably 1 μm or less, more preferably 700 nm or less, even more preferably 500 nm or less. These layered silicate may be either natural or synthetic one, and may be used alone or as a mixture of two or more kinds.

(3) Polyurethane Resin Used in the Present Invention

The polyurethane resin used in the present invention is not particularly limited as long as the resin has a "secondary or tertiary amine structure" in a molecular chain thereof and a plurality of urethane bonds. For example, the polyurethane resin can be obtained by reacting the polyisocyanate, the polyol and the compound introducing a secondary or tertiary amine structure. Additionally, the polyurethane resin having the "secondary amine or tertiary amine structure" in a molecular chain thereof used in the present invention may be, for example, any of a polyurethane resin having a secondary amine structure in a molecular chain thereof, a polyurethane resin having a tertiary amine structure in a molecular chain thereof, and a polyurethane resin having a secondary and tertiary amine structure in a molecular chain thereof. In the present invention, the "secondary or tertiary amine structure" does not include a structure derived from an urethane bond or a urea bond of the polyurethane resin.

The polyisocyanate component constituting the polyurethane resin used in the present invention is not particularly limited as long as it has two or more isocyanate groups. Such examples include an aromatic polyisocyanate such as 2,4-toluene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI), and paraphenylene diisocyanate (PPDI); and an alicyclic polyisocyanate or aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI). These may be used alone, or as a mixture of two or more kinds.

In view of improving abrasion-resistance, as the polyisocyanate component of the polyurethane resin, it is preferred to use an aromatic polyisocyanate. By using the aromatic polyisocyanate, the mechanical property of the resultant polyurethane is improved, and the cover which is excellent in abrasion-resistance can be obtained. Further, in view of improving the weather resistance, as the polyisocyanate component of the polyurethane, it is preferred to use a non-yellowing type polyisocyanate such as TMXDI, XDI, HDI, $H_6$XDI, IPDI, $H_{12}$MDI and NBDI, more preferably 4,4'-dicyclohexylmethane diisocyanate ($H_{12}$MDI). It is because 4,4'-dicyclohexylmethane diisocyanate ($H_{12}$MDI) has a rigid structure, so that the mechanical property of the resultant polyurethane is improved, and the cover which is excellent in abrasion-resistance can be obtained.

The polyol component constituting the polyurethane resin is not particularly limited as long as it has a plurality of hydroxyl groups. Such examples include a polyol having a low-molecular weight, a polyol having a high molecular weight and the like. Examples of the low-molecular weight polyol include a diol such as ethylene glycol, diethylene glycol, triethylene glycol, 1,3-butanediol, 1,4-butanediol, neopentyl glycol, and 1,6-hexanediol; and a triol such as glycerin, trimethylol propane, and hexanetriol. Examples of the high-molecular weight polyol include a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ε-caprolactone (PCL); polycarbonate polyol such as polyhexamethylene carbonate; and an acrylic polyol. A mixture of at least two kinds of the polyols described above may also be used.

An average molecular weight of the high-molecular weight polyol is not particularly limited, and it is preferably, for example, 400 or more, more preferably 1000 or more. If the average molecular weight of the high-molecular weight polyol becomes too small, the resultant polyurethane becomes too hard, so that shot feeling of the golf ball becomes lowered. An upper limit of the average molecular weight of the high-molecular weight polyol is not particularly limited, and it is preferably 10000 or less, more preferably 8000 or less.

Examples of the compound which introduces the secondary or the tertiary amine structure into the skeleton of the polyurethane resin include diethanolamine, N-methyl diethanolamine, N-isobutyl diethanolamine, N-aminopropyl piperazine, 1,4-bis aminopropyl piperazine, N-hydroxyethoxyethyl piperazine, methyliminobispropylamine, iminobispropylamine, N,N-dibenzyl ethanolamine, N-hydroxyethoxyethyl piperazine, N-benzyl-N-methylethanolamine, diethanol aminopropylamine, N-aminoethyl piperazine, N-aminoethyl-4-pipecoline N-aminopropyl piperazine, N-aminopropyl-2-pipecoline N-aminopropyl-4-pipecoline N-aminoethyl morpholine, N-aminopropyl morpholine, 2-hydroxy-5-pyridine methanol, 2-amino-5-amino methyl pyridine, 2-amino-5-pyridine methanol and the like. The compounds may also be used as a mixture of two or more kinds. These compounds can introduce a secondary amine structure or tertiary amine structure in a molecular chain of a resultant polyurethane resin by taking the reactivity with the polyisocyanate into consideration and using them appropriately.

For example, a polyol having a tertiary amine structure such as N-methyl diethanolamine and N-isobutyl diethanolamine can facilitate the introduction of the tertiary amine structure into a molecular chain of the resultant polyurethane resin, by reacting with the polyisocyanate. The secondary amine structure can be suitably introduced utilizing the difference in reactivity of the secondary amine (imino group) and the primary amine (amino group) with an isocyanate group. For example, an iminobis propylamine is a polyamine having a secondary amine structure (imino group) and a primary amine structure (amino group), and since the primary amine (amino group) has higher reactivity with an isocyanate group than the secondary amine (imino group), the primary amine (amino group)and the isocyanate group of the polyisocyanate are selectively reacted by suitably controlling a molar ratio of the isocyanate group and the primary amine (amino group), thereby introducing a secondary amine structure (imino group) into the resultant polyurethane resin molecular chain. For example, diethanolamine has a secondary amine structure (imino group) and hydroxyl group, and if the secondary amine structure (imino group) is neutralized to cationize in advance, an isocyanate group and a hydroxyl group can be reacted selectively. If the secondary or tertiary amine structure is introduced into a terminal of a molecular chain of the polyurethane resin, for example, a compound of N,N-dibenzyl ethanolamine, N-hydroxyethoxyethyl piperazine, N-benzyl-N-methylethanolamine, diethanol aminopropylamine, N-aminoethyl piperazine, N-aminoethyl-4-pipecoline N-aminopropyl piperazine, N-aminopropyl-2-pipecoline N-aminopropyl-4-pipecoline N-aminoethyl morpholine, N-aminopropyl morpholine and the like may be used.

In the present invention, "cationizing" means forming an amine of secondary or tertiary structure into an ammonium salt (a secondary ammonium salt, a tertiary ammonium salt, or a quaternary ammonium salt). For instance, a method includes a method of forming a secondary ammonium salt or a tertiary ammonium salt by neutralizing a secondary amine or a tertiary amine with an acid such as acetic acid, hydrochloric acid, and sulfuric acid; and a method of forming a quaternary ammonium salt using a quaternizing agent such as an alkyl halide including methyl chloride, methyl bromide, methyl iodide, ethyl chloride, ethyl bromide, and ethyl iodide, and dimethyl sulfate and diethyl sulfate. The method of forming the secondary ammonium salt or the tertiary ammonium salt with the acid such as acetic acid, hydrochloric acid, and sulfuric acid is preferable.

The constitutional embodiments of the polyurethane resin having a secondary or tertiary amine structure in a molecular chain used in the present invention is not particularly limited. Examples include an embodiment where the polyurethane resin is composed of the polyisocyanate component and the compound component having the secondary or tertiary amine structure; an embodiment where the polyurethane resin is composed of the polyisocyanate component, the high-molecular weight polyol component and the compound component having the secondary or tertiary amine structure; an embodiment where the polyurethane resin is composed of the polyisocyanate component, the high-molecular weight polyol component, the low-molecular weight polyol component and the compound component having the secondary or tertiary amine structure; an embodiment where the polyurethane resin is composed of the polyisocyanate component, the high-molecular weight polyol component, the low-molecular weight polyol component, and the polyamine component and the compound component having the secondary or tertiary amine structure; and an embodiment where the polyurethane resin is composed of the polyisocyanate component, the high-molecular weight polyol component, the polyamine component and the compound component having the secondary or tertiary amine structure.

(4) In the present invention, it is a preferred embodiment that the cover is formed from the cover composition which comprises a polyisocyanate, a polyol and a polyol-layered silicate composite treated with a polyol having a secondary or tertiary amine structure (preferably tertiary amine structure). In a more preferred embodiment, the cover is formed from the cover composition which comprises a polyisocyanate, a polyol and an urethane polyol-layered silicate composite treated with an urethane polyol having a secondary or tertiary amine structure (preferably tertiary amine structure).

(4-1) Herein, the "polyol-layered silicate composite treated with a polyol having a secondary or tertiary amine structure" is a layered silicate wherein the secondary or tertiary amine structure of the polyol is cationized, and the cationized polyol is intercalated between layers of the layered silicate and bonded to the layered silicate via an electrostatic interaction. More specifically, in the embodiment of forming the cover from the cover composition which comprises the polyisocyanate, the polyol and the polyol-layered silicate composite treated with the polyol having the secondary or tertiary amine structure, the cationized polyol intercalated between layers of the layered silicate and bonded to the layered silicate via an electrostatic interaction is used. Thus, the cationized polyol having a relatively low-molecular weight intercalated between layers of the layered silicate is allowed to react with the polyisocyanate and the polyol to be polymerized, thereby facilitating the intercalation of the cationized polyurethane resin between the layers of the layered silicate, compared with the method of directly intercalating the cationized polyurethane resin having a high molecular weight between layers of the layered silicate.

(4-2) First, "the polyol having the secondary or tertiary amine structure" is explained.

The "polyol having the secondary or tertiary amine structure" is the compound having the secondary or tertiary amine structure and a plurality of hydroxyl groups in a molecule thereof. Examples thereof include diethanolamine, N-methyl diethanolamine, N-isobutyl diethanolamine, a urethane polyol having a secondary or tertiary amine structure, and the urethane polyol having the secondary or tertiary amine structure is preferably used.

The "urethane polyol having the secondary or tertiary amine structure" used in the embodiment is a compound having the secondary or tertiary amine structure, an urethane bond and a plurality of hydroxyl groups in a molecule. For example, it is synthesized by reacting the polyisocyanate with the above mentioned "polyol having the secondary or tertiary amine structure" under a condition that the hydroxyl groups of the polyol component is in excess with respect to the isocyanate groups of the polyisocyanate component. By using the polyol having the secondary or tertiary amine structure as the polyol component of the urethane polyol, the secondary or tertiary amine structure can be introduced into the resultant urethane polyol. In a more preferred embodiment of the present invention, the urethane polyol having the tertiary amine structure is used.

The polyisocyanate used for synthesizing the urethane polyol is not particularly limited as long as it has two or more isocyanate groups. Such examples include an aromatic polyisocyanate such as 2,4-toluene diisocyanate, 2,6-tolylene diisocyanate, a mixture of 2,4-tolylene diisocyanate and 2,6-tolylene diisocyanate (TDI), 4,4'-diphenyl methane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI), and an alicyclic polyisocyanate or aliphatic polyisocyanate such as paraphenylene diisocyanate (PPDI); 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), norbornene diisocyanate (NBDI). These may be used alone or as a mixture of two or more kinds. Among them, in view of weather resistance, a non-yellowing type polyisocyanate (such as TMXDI, XDI, HDI, $H_6$XDI, IPDI, $H_{12}$MDI, and NBDI) is preferably used.

In another preferred embodiment, the another polyol may be used in addition to the polyisocyanate and the polyol having the secondary or tertiary amine structure, when synthesizing the urethane polyol having the secondary or tertiary amine structure. The another polyol is not particularly limited as long as it has a plurality of hydroxyl groups, and such examples include a low-molecular weight polyol and a high-molecular weight polyol. Examples of the low-molecular weight polyol include a diol such as ethylene glycol, diethylene glycol, triethylene glycol, 1,3-butanediol, 1,4-butanediol, neopentyl glycol, and 1,6-hexanediol; and a triol such as glycerin, trimethylol propane, and hexanetriol. Examples of the high-molecular weight polyol include a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ε-caprolactone (PCL); a polycarbonate polyol such as polyhexamethylene carbonate; an acrylic polyol and the like. Among the polyols, one having a weight average molecular weight of 50 to 2,000, particularly about 100 to 1,000 is preferably used. These polyols may be used alone, or as a mixture of two or more kinds.

The urethane polyol having the tertiary amine structure is synthesized, for example, by reacting the polyisocyanate, the polyol having the tertiary amine structure and another polyol under a condition that hydroxyl groups of the polyols are in excess with respect to isocyanate groups of the polyisocyanate. Specific examples include an embodiment composed of two stages comprising reacting the polyol having the tertiary amine structure and the polyisocyanate under a condition that the polyisocyanate groups are in excess to obtain an isocyanate group-terminated urethane prepolymer followed by adding another polyol to the isocyanate group-terminated urethane prepolymer such that the hydroxyl groups of the polyol component is in excess with respect to the isocyanate groups to bring about a reaction; and an embodiment of adding the polyisocyanate, the polyol having the tertiary amine structure and another polyol to be reacted altogether. In the embodiment of synthesizing the urethane polyol having the tertiary amine structure in two stages, the polyol component and the polyisocyanate component may also be slowly added thereto if necessary.

In the reaction, a solvent and a catalyst publicly known for an urethane reaction (such as dibutyl tin dilaurylate) can be used. As a condition for the reaction, a condition for a normal urethane reaction may be suitably selected, such as under conditions of dry nitrogen atmosphere at 20° C. to 100° C. A ratio of the urethane bond can be adjusted by adjusting a molecular weight of the polyol component, a blending ratio of the polyol component and the polyisocyanate as raw materials, and the like.

A weight average molecular weight of the resultant urethane polyol having the secondary or tertiary amine structure is not particularly limited, but it is preferably about 50,000 to 200,000.

(4-3) Next, "polyol-layered silicate composite" will be explained.

The polyol-layered silicate composite is obtained by treating the layered silicate with the above-described polyol having the secondary or tertiary amine structure. Specifically, the polyol-layered silicate composite is obtained by cationizing the polyol having the secondary or tertiary amine structure in the molecule and dispersing the layered silicate in the cationized polyol.

The "cationization of the secondary or tertiary amine structure" is, as described above, forming the amine of secondary or tertiary structure of the polyol into an ammonium salt (secondary ammonium salt, tertiary ammonium salt, or a quaternary ammonium salt), and includes a method of forming the secondary or tertiary ammonium salt by neutralizing the secondary or tertiary amine with an acid such as acetic acid, hydrochloric acid, and sulfuric acid, and a method of forming the quaternary ammonium salt by using a quaternizing agent such as an alkyl halide like methyl chloride, methyl bromide, methyl iodide, ethyl chloride, ethyl bromide, and ethyl iodide, and dimethyl sulfate, diethyl sulfate. Preferred is the method of forming the secondary or tertiary ammonium salt with the acid such as acetic acid, hydrochloric acid, and sulfuric acid.

In a preferred embodiment of "cationization," the polyol having the secondary or tertiary amine structure is dispersed in a solvent such as water and an alcohol, and the acid such as acetic acid, hydrochloric acid, and sulfuric acid is added to the obtained dispersion liquid. A degree of "cationization" is not particularly limited, but 70 mol % or more of "secondary or tertiary amine structure" of the polyol is preferably cationized, more preferably 85 mol % or more, even more preferably 100 mol % or more.

Next, the layered silicate is dispersed in the cationized polyol to make the composite of the cationized polyol and the layered silicate. Dispersing the layered silicate in the cationized polyol is not particularly limited, but for example, carried out at the temperature of 5° C. to 75° C. for 24 hours to 72 hours while stirring. With respect to a blending ratio of the layered silicate and the cationized polyol, the cationized polyol equivalent to 1 to 2 times an amount of the cation exchange capacity of the layered silicate is preferably blended.

If the layered silicate is modified with the urethane polyol having the secondary or tertiary amine structure in a molecule thereof, an interlayer spacing of the layered silicate composite to be obtained can be controlled by suitably selecting the polyol component used for synthesizing the urethane polyol. If the interlayer spacing of the polyol-layered silicate composite becomes larger, the reactivity between the cationized urethane polyol and the polyisocyanate component becomes high, and thus the reinforcing effect of the layered silicate is further enhanced. For example, if polyoxytetramethylene glycol having a high hydrophobic property is used as a polyol component of the urethane polyol, the interlayer spacing of the resultant urethane polyol-layered silicate composite becomes larger, while if polyoxyethylene glycol having a high hydrophilicity is used, an interlayer spacing of the resultant urethane polyol-layered silicate composite becomes smaller.

The layered silicate are modified with the polyol having the secondary or tertiary amine structure to make the composite, and then separated and washed to purify the polyol-layered silicate composite. Namely, from the polyol-layered silicate composite, an unreacted cationized polyol, or a solvent added as necessary and the like are removed. A separating method is not particularly limited, and includes, for example, centrifugation. A washing method is not particularly limited, and includes a method of washing by dispersing the separated polyol-layered silicate composite in an ion-exchange water. It is also a preferred embodiment that the polyol-layered silicate composite obtained by separating and washing is subjected to freeze drying, pulverizing, and drying. The freeze drying is preferably performed for 2 to 7 days. The method of pulverizing is not particularly limited, and includes a method of grinding with a mortar and the like. In a preferred embodiment, the pulverizing is carried out to the extent that an average particle diameter becomes about 0.1 μm to 100 μm.

The polyol-layered silicate composite obtained by pulverizing is dried again if necessary. If moisture exists during a reaction with the polyisocyanate, the polyisocyanate and the moisture react with each other to cause foaming. Drying conditions are not particularly limited, and for example, the polyol-layered silicate composite may be dried in a vacuum oven at 80° C. for 1 day.

In the polyol-layered silicate composite, the cationized polyol is intercalated between layers of the layered silicate, and thus a distance between layers becomes wider, or a layered structure of the layered silicate is broken up into a single-leaf like state. Accordingly, there is characteristic that, when the polyol-layered silicate composite is measured by X-ray diffraction, an interlayer spacing of the resultant layered silicate is preferably 2.7 nm or more, more preferably 5 nm or more, even more preferably 9.4 nm or more, or that a X-ray diffraction peak derived from the layered silicate is not observed.

Additionally, the polyol-layered silicate composite preferably has a particle diameter (major axis) in a range from 0.1 μm to 100 μm, more preferably from 1 μm to 20 μm, further preferably from 5 μm to 10 μm. The particle diameter can be obtained based on TEM observation photograph of the urethane polyol-layered silicate composite.

In the present invention, as the polyol-layered silicate composite treated with the polyol having the secondary or tertiary amine structure, preferably used is the urethane polyol-layered silicate composite treated with the urethane polyol having the secondary or tertiary amine structure, more preferably the urethane polyol-layered silicate composite treated with the urethane polyol having the tertiary amine structure.

(4-4) In the above embodiment, a preferred embodiment is that the cover is formed from the cover composition which comprises the polyisocyanate, the polyol and the urethane polyol-layered silicate composite treated with the urethane polyol having the tertiary amine structure.

The polyisocyanate blended in the cover composition is not particularly limited as long as it has two or more isocyanate groups. Such examples include an aromatic polyisocyanate such as 2,4-tolylene diisocyanate, 2,6-tolylene diisocyanate, a mixture of 2,4-tolylene diisocyanate and 2,6-toluene diisocyanate (TDI), 4,4'-diphenylmethane diisocyanate(MDI), 1,5-naphthylene diisocyanate (NDI), 3,3'-bitolylene-4,4'-diisocyanate (TODI), xylylene diisocyanate (XDI), tetramethylxylylene diisocyanate (TMXDI), and paraphenylene diisocyanate (PPDI); an alicyclic polyisocyanate or an aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI). These may be used alone or a mixture of two or more kinds.

In view of improving the abrasion-resistance, as the polyisocyanate component of the polyurethane, it is preferred to use an aromatic polyisocyanate. By using the aromatic polyisocyanate, the mechanical property of the resultant polyurethane is improved, and the cover which is excellent in the abrasion-resistance can be obtained. Further, in view of improving the weather resistance, as the polyisocyanate component of the polyurethane, it is preferred to use a non-yellowing type polyisocyanate such as TMXDI, XDI, HDI, $H_6$XDI, IPDI, $H_{12}$MDI and NBDI, more preferably 4,4'-dicyclohexylmethane diisocyanate ($H_{12}$MDI). It is because 4,4'-dicyclohexylmethane diisocyanate ($H_{12}$MDI) has a rigid structure, so that the mechanical property of the resultant polyurethane is improved, and the cover which is excellent in the abrasion-resistance can be obtained.

The polyol blended in the cover composition is not particularly limited as long as it has a plurality of hydroxyl groups, and examples include a low-molecular weight polyol and a high-molecular weight polyol. Examples of the low-molecular weight polyol include a diol such as ethylene glycol, diethylene glycol, triethylene glycol, 1,3-butanediol, 1,4-butanediol, neopentyl glycol, and 1,6-hexanediol; a triol such as glycerin, trimethylol propane, and hexanetriol. Examples of the high-molecular weight polyol include a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA) and polyhexamethylene adipate (PHMA); a lactone polyester polyol such as poly-ε-caprolactone (PCL); a polycarbonate polyol such as polyhexamethylene carbonate; and an acrylic polyol. Among the above-described polyols, a polyol having a weight average molecular weight of about 50 to 2,000, particularly about 100 to 1,000 is preferably used. These polyols may be used alone, or as a mixture of two or more kinds.

The cover composition may contain a pigment component such as zinc oxide, titanium oxide, and a blue pigment, a gravity adjusting agent such as calcium carbonate and barium sulfate, a dispersant, an antioxidant, an ultraviolet absorber, a light stabilizer, a fluorescent material, a fluorescent brightener or the like in addition to the polyisocyanate, the polyol, and the (urethane) polyol-layered silicate composite within the range that the cover performance is not undermined.

(5) Method for Molding Cover

A method for molding the cover of the golf ball of the present invention is not particularly limited. Examples of such a method include a method which comprises cationizing the secondary or tertiary amine structure of the thermoplastic polyurethane resin having the secondary or tertiary amine structure in the molecular chain thereof, melting the resultant cationized thermoplastic polyurethane resin, charging a slurry obtained by dispersing the layered silicate in water in advance thereto followed by kneading to prepare the cover composition in the form of pellet containing the polyurethane resin having the secondary or tertiary amine structure in a molecular chain and the layered silicate and forming a cover using the composition by compression molding or injection molding (slurry method); and a method which comprises reacting in advance the cover composition containing the polyisocyanate, the polyol and the (urethane) polyol-layered silicate composite treated with the (urethane) polyol having the secondary or tertiary amine structure to form into the cover composition in the form of pellet containing the layered silicate and the high molecular weight polyurethane resin having the secondary or tertiary amine structure in a molecular chain and using the composition to form the cover by compression molding or injection molding; and a method which comprises directly covering the core with an uncured cover composition containing the polyisocyanate, the polyol and the (urethane) polyol-layered silicate composite treated with the above described (urethane) polyol having the secondary or tertiary amine structure and curing the composition to form the cover, and the like.

In an embodiment where the cover composition is reacted in advance and the cover composition containing a layered silicate and a high molecular weight polyurethane resin having the secondary or tertiary amine structure in a molecular chain in the form of pellet is used, for example, employed is a method which comprises molding the cover composition in advance into two hemispherical half shells, covering the core together with the two half shells and subjecting the core with two half shells to the pressure molding at 130 to 170° C. for 1 to 5 minutes; or a method which comprises injection molding the cover composition directly onto the core to cover the core. In an embodiment using the cover composition in an uncured embodiment, for example, a cover is prepared by holding a core in a hemispherical-shaped mold filled with the composition and curing the composition to prepare a hemispherical-shaped cover followed by inverting the core to combine it with another hemispherical mold filled with the composition to cure the composition.

Further, when forming the cover, the cover can be formed with a plurality of concavities, which is so called "dimple", at the surface thereof. As required, the surface of the golf ball can be subjected to grinding treatment such as sandblast in order to improve adhesion with a mark and a paint film.

(6) Cover

The cover of the golf ball of the present invention is not particularly limited as long as it contains the layered silicate and the polyurethane resin having the secondary or tertiary amine structure in a molecular chain thereof.

A content of the layered silicate in the cover is preferably 0.05 mass % or more, more preferably 0.25 mass % or more, further preferably 0.5 mass % or more, and preferably 7.5 mass % or less, more preferably 5 mass % or less, further preferably 4 mass % or less. By making the content within the above range, the abrasion-resistance and spin performance become good.

The resin component constituting the cover of the golf ball of the present invention, may include another resin in addition to the polyurethane resin having the secondary or tertiary amine structure, within the range that effects of the present invention are not undermined. The content of the polyurethane resin having the secondary or the tertiary amine structure in the resin component constituting the cover of the golf ball of the present invention is 50 mass % or more, more preferably 70 mass % or more, further preferably 90 mass % or more. Further, it is also a preferred embodiment that resin component constituting the cover essentially consists of the polyurethane resin having the secondary or tertiary amine structure.

In the present invention, a resin which can be used as the resin component constituting the cover other than the polyurethane resin having the secondary or tertiary amine structure in a molecular chain includes a thermoplastic resin and a thermoplastic elastomer. Examples of the thermoplastic resin include an ionomer resin, and examples of the ionomer resin include one prepared by neutralizing at least a part of carboxyl groups in a copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms, and α,β-unsaturated carboxylic acid ester with a metal ion, or a mixture thereof. The specific examples of the ionomer resin include Himilan available from MITSUI-DUPONT POLYCHEMICAL, Surlyn available from DUPONT CO., and Iotek available from ExxonMobil Corp.

The specific examples of the thermoplastic elastomer include a thermoplastic polyamide elastomer having a commercial name of "PEBAX", for example, "PEBAX 2533" available from ARKEMA Inc, a thermoplastic polyester elastomer having a commercial name of "HYTREL", for example, "HYTREL 3548", and "HYTREL 4047" available from DU PONT-TORAY Co., a thermoplastic polyurethane elastomer having a commercial name "ELASTOLLAN", for example, "ELASTOLLAN XNY97A" available from BASF Japan Ltd. and a thermoplastic polystyrene elastomer having a commercial name of "Rabalon" available from Mitsubishi Chemical Co.

The cover may contain, in addition to the polyurethane resin having the secondary or the tertiary amine structure and the layered silicate, a pigment component such as zinc oxide, titanium oxide, a blue pigment, a gravity adjusting agent such as calcium carbonate and barium sulfate, a dispersant, an antioxidant, an ultraviolet absorber, a light stabilizer, a fluorescent material or a fluorescent brightener within the range that the cover performance is not undermined.

The thickness of the cover of the golf ball of the present invention is not particularly limited, but it is preferably 0.3 mm or more, more preferably 0.4 mm or more, further preferably 0.5 mm or more, and preferably 2.0 mm or less, more preferably 1.6 mm or less, further preferably 1.2 mm or less. If the thickness of the cover is less than 0.3 mm, the cover becomes too thin so that the durability is lowered, while if it is more than 2.0 mm, the cover becomes too thick so that resilience is lowered.

(7) Structure of Golf Ball of the Present Invention

A structure of the golf ball of the present invention is not particularly limited as long as it has a core and a cover. Specific examples of the golf ball of the present invention include a two-piece golf ball having a core and a cover covering the core; a three-piece golf ball comprising a core composed of a center and an intermediate layer covering the center and an outermost layer cover covering the core; a multi-piece golf ball having a core composed of a center and a plurality of or multi-layered intermediate layers and an outermost layer cover covering the core; and a wound-core golf ball having a wound core and a cover covering the wound core, and the like. In the three-piece golf ball or the multi-piece golf ball, if the intermediate layer is regarded as part of the core, it may be referred to as a multi layered core, while if the intermediate layer is regarded as part of the cover, it may be referred to as a multi layered cover.

The core or the center of the golf ball of the present invention is preferably one molded by heat-pressing a rubber composition (hereinafter simply referred to as "rubber composition for the core") containing, for example, a base rubber, a crosslinking initiator, a co-crosslinking agent, and, as necessary, a filler.

As the base rubber, a natural rubber or a synthetic rubber may be used. For example, a polybutadiene rubber, a natural rubber, a polyisoprene rubber, a styrene polybutadiene rubber, and an ethylene-propylene-diene rubber (EPDM) and the like may be used. Among them, in particular, a high cis-polybutadiene, particularly cis-1,4-polybutadiene having a cis bond of 40% or more, preferably 70% or more, more preferably 90% or more is preferably used in view of its superior repulsion property.

The crosslinking initiator is blended in order to crosslink the base rubber component. As the crosslinking initiator, an organic peroxide is preferred. Specifically, the crosslinking initiator includes an organic peroxide such as dicumyl peroxide, 1,1-bis (t-butylperoxy)-3,5-trimethylcyclohexane, 2,5-dimethyl-2,5-di(t-butylperoxy) hexane, and di-t-butyl peroxide. Among these, dicumyl peroxide is preferably used. An amount of the organic peroxide to be blended is preferably 0.2 part by mass or more, more preferably 0.3 part by mass or more and preferably 3 parts by mass or less, more preferably 2 parts by mass or less with respect to 100 parts by mass of the base rubber. If it is less than 0.2 part by mass, the core becomes too soft so that resilience tends to be lowered, while if it is more than 3 parts by mass, an amount of the co-crosslinking agent needs to be increased to obtain an appropriate hardness, so that resilience tends to become insufficient.

The co-crosslinking agent is not particularly limited as long as it has the effect of crosslinking a rubber molecule by graft polymerization with a base rubber molecular chain; for example, α,β-unsaturated carboxylic acid having 3 to 8 carbon atoms or a metal salt thereof, more preferably, acrylic acid, methacrylic acid or a metal salt thereof may be used. As the metal constituting the metal salt, for example, zinc, magnesium, calcium, aluminum and sodium may be used, and among them, zinc is preferred because it provides high resilience. If the core has a double layer structure composed of an inner layer core and an outer layer core and the outer layer core is made thin, a zinc salt of α,β-unsaturated carboxylic acid which provides high resilience, particularly zinc acrylate, is preferred for the inner layer core, and for the outer layer core, a magnesium salt of α,β-unsaturated carboxylic acid which has a good mold-releasing property, particularly magnesium methacrylate is preferred.

An amount of the co-crosslinking agent to be used is preferably 10 parts by mass or more, more preferably 20 parts by mass or more and preferably 50 parts by mass or less, more preferably 40 parts by mass or less with respect to 100 parts by mass of the base rubber. If an amount of the co-crosslinking agent to be used is less than 10 parts by mass, an amount of the organic peroxide must be increased in order to obtain an appropriate hardness, so that resilience tends to be lowered. On the other hand, if an amount of the co-crosslinking agent to be used is more than 50 parts by mass, the core becomes too hard so that shot feeling tends to be lowered.

The filler contained in the rubber composition for the core is mainly blended as a gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 2 parts by mass or more, more preferably 3 parts by mass or more, and preferably 50 parts by mass or less, more preferably 35 parts by mass or less based on 100 parts by mass of the base rubber. If the amount of filler to be blended is less than 2 parts by mass, it becomes difficult to adjust the weight, while if it is more than 50 parts by mass, the weight ratio of the rubber component becomes small and the resilience tends to be lowered.

As the rubber composition for the core, an organic sulfur compound, an antioxidant or a peptizing agent may be blended as appropriate in addition to the base rubber, the crosslinking initiator, the co-crosslinking agent and the filler As the organic sulfur compound, a diphenyl disulfide or a derivative thereof may be preferably used. The amount of the diphenyl disulfide or the derivative thereof to be blended is preferably 0.1 part by mass or more, more preferably 0.3 part by mass or more, and preferably 5.0 parts by mass or less, more preferably 3.0 parts by mass or less relative to 100 parts by mass of the base rubber. Examples of the diphenyl disulfide or the derivative thereof include diphenyl disulfide, a mono-substituted diphenyl disulfide such as bis (4-chlorophenyl) disulfide, bis (3-chlorophenyl) disulfide, bis (4-bromophenyl) disulfide, bis (3-bromophenyl) disulfide, bis (4-fluorophenyl) disulfide, bis (4-iodophenyl) disulfide and bis (4-cyanophenyl) disulfide; a di-substituted diphenyl disulfide such as bis (2,5-dichlorophenyl) disulfide, bis (3,5-dichlorophenyl) disulfide, bis (2,6-dichlorophenyl) disulfide, bis (2,5-dibromophenyl) disulfide, bis (3,5-dibromophenyl) disulfide, bis (2-chloro-5-bromophenyl) disulfide, and bis (2-cyano-5-bromophenyl) disulfide; a tri-substituted diphenyl disulfide such as bis (2,4,6-trichlorophenyl) disulfide, and bis (2-cyano-4-chloro-6-bromophenyl) disulfide; a tetra-substituted diphenyl disulfide such as bis (2,3,5,6-tetra chlorophenyl) disulfide; a penta-substituted diphenyl disulfide such as bis (2,3,4,5,6-pentachlorophenyl) disulfide and bis (2,3,4,5,6-pentabromophenyl) disulfide. These diphenyl disulfides or the derivative thereof can enhance resilience by having some influence on the state of vulcanization of vulcanized rubber. Among them, diphenyl disulfide and bis (pentabromophenyl) disulfide are preferably used since a golf ball having particularly high resilience can be obtained.

An amount of the antioxidant to be blended is preferably 0.1 part by mass or more and 1 part by mass or less with respect to 100 parts by mass of the base rubber. The peptizing agent is preferably 0.1 part by mass or more, 5 parts by mass or less with respect to 100 parts by mass of the base rubber.

The conditions for press-molding the rubber composition should be determined depending on the rubber composition. The press-molding is preferably carried out for 10 to 60 minutes at the temperature of 130 to 200° C. Alternatively, the press-molding is preferably carried out in a two-step heating, for example, for 20 to 40 minutes at the temperature of 130 to 150° C., and continuously for 5 to 15 minutes at the temperature of 160 to 180° C.

The core of the golf ball of the present invention includes a single-layered core, a core consisting of a center and a single-layered intermediate layer covering the core, a core consisting of a center and a plurality of intermediate layers, or a core consisting of a center and a multi-layered intermediate layers. The core preferably has a spherical shape. If the core does not have a spherical shape, the cover does not have a uniform thickness. As a result, there exist some portions where the performance of the cover is lowered. On the other hand, the center generally has the spherical shape, but the center may be provided with a rib on the surface thereof so that the surface of the spherical center is divided by the ribs, preferably the surface of the spherical center is evenly divided by the ribs. In one embodiment, the ribs are preferably formed on the surface of the spherical center in an integrated manner, and in another embodiment, the ribs are formed as an intermediate layer on the surface of the spherical center.

If the spherical center is regarded as the Earth, the ribs are preferably formed along an equatorial line and meridians that evenly divide the surface of the spherical center. For example, if the surface of the spherical center is evenly divided into 8, the ribs are formed along the equatorial line, any meridian as a standard, and meridians at the longitude 90 degrees east, longitude 90 degrees west, and the longitude 180 degrees east (west), assuming that the meridian as the standard is at longitude 0 degrees. If the ribs are formed, the depressed portion divided by the ribs are preferably filled with a plurality of intermediate layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

A diameter of the center of the golf ball of the present invention is preferably 30 mm or more, more preferably 32 mm or more, and preferably 41 mm or less, more preferably 40.5 mm or less. If the diameter of the center is less than 30 mm, it is necessary to make the intermediate layer or the cover thicker than a desired thickness, and as a result, resilience may become lowered. On the other hand, if the diameter of the center is more than 41 mm, it is necessary to make an intermediate layer or a cover thinner than a desired thickness, so that the intermediate layer or the cover layer cannot function sufficiently.

A core used for the golf ball of the present invention preferably has a diameter of 39 mm or more, more preferably 39.5 mm or more, even more preferably 40.8 mm or more, and preferably has a diameter of 42.2 mm or less, preferably 42 mm or less, more preferably 41.8 mm or less. If the diameter of the core is less than the lower limit, the cover may become too thick so that resilience becomes lowered. On the other hand, if the diameter of the core is more than the upper limit, the thickness of the cover becomes too thick so that molding of the cover becomes difficult.

It is a preferred embodiment that, the core having a surface hardness larger than the center hardness (if the core is a multi layered core, one having a surface hardness of the outermost layer larger than a center hardness of the center) is used. By making the surface hardness of the core larger than the center hardness, a launch angle is increased and an amount of spin is lowered, so that flying distance is improved. From this viewpoint, a difference in the hardness between a surface and a center of the core used for the golf ball the present invention is preferably 20 or more, more preferably 25 or more, and preferably 40 or less, more preferably 35 or less. If the difference of the hardness is less than the above lower limit, it is difficult to obtain a high launch angle and a low amount of spin, so that the flying distance tends to be lowered. Further, impact strength when hitting the golf ball becomes large so that it is difficult to obtain a good soft shot feeling. On the other hand, if the difference in hardness is more than the above upper limit, the durability tends to be lowered.

The center hardness of the core is preferably 30 D or more, more preferably 32 D or more, even more preferably 35 D or more, and is preferably 50 D or less, more preferably 48 D or less, even more preferably 45 D or less in shore D hardness. If the center hardness is less than the above lower limit, the golf ball tends to become so soft that the resilience will be lowered, while if the center hardness is more than the above upper limit, the golf ball becomes so hard that the shot feeling and launch angle become lowered, and the amount of spin also becomes larger so that the flying performance become lowered. In the present invention, the center hardness of the core means the hardness obtained by measuring the central point of the cut surface of the core cut into halves with the Shore D type spring hardness tester.

The surface hardness of the core is preferably 45 D or more, more preferably 50 D or more, even more preferably 55 D or more, and preferably 65 D or less, more preferably 62 D or less, even more preferably 60 D or less in shore D hardness. If the surface hardness is less than the above lower limit, the golf ball may become too soft, resulting in lowering of resilience and launch angle, or the amount of spin may become too large, resulting in lowering of flying performance. If the surface hardness is larger than the upper limit, the golf ball may become too hard, resulting in lowering of the shot feeling. In the present invention, the surface hardness of the core means the hardness obtained by measuring at the surface of the resultant spherical core using the Shore D type spring hardness tester. If the core has a multi layered structure, the surface hardness of the core means a hardness of a surface of the outermost layer of the core.

When preparing a multi-piece golf ball or a three-piece golf ball, a material for the intermediate layer includes, for example, a thermoplastic resin or a thermoplastic elastomer such as an ionomer resin, a polystyrene elastomer, a polyolefin elastomer, a polyurethane elastomer, a polyester elastomer, a polyamide elastomer and the like, more preferably the ionomer resin. As the intermediate layer, for example, a cured product of the rubber composition may also be used. Into the intermediate layer, a gravity adjusting agent such as a barium sulfate and tungsten, an antioxidant, a pigment and the like may be further blended.

A method of forming the intermediate layer is not particularly limited, and typically employed is a method including previously molding the material for the intermediate layer into two hemispherical half shells, covering the core together with the two half shells, and subjecting the core with two half shells to the pressure molding, or a method including injection-molding the material for the intermediate layer directly onto the core to form a cover.

When preparing a wound-core golf ball in the present invention, a wound core may be used as the core. In that case, for example, a wound core comprising a center formed by curing the above rubber composition for the core and a rubber thread layer which is formed by winding a rubber thread around the center in an elongated state can be used. In the present invention, the rubber thread, which is conventionally used for winding around the center, can be adopted for winding around the center. The rubber thread, for example, is obtained by vulcanizing a rubber composition including a natural rubber, or a mixture of a natural rubber and a synthetic polyisoprene, sulfur, a vulcanization auxiliary agent, a vulcanization accelerator, and an antioxidant. The rubber thread is wound around the center in elongation of about 10 times length to form the wound core.

EXAMPLES

Hereinafter, the present invention will be described in more detail with reference to Examples, but the present invention is not restricted by the following Examples and can be suitably modified within the scope described above or below and such modifications are also included in the technical scope of the present invention.

[Evaluation Method]

(1) Abrasion-Resistance

A commercially available sand wedge was installed on a swing robot available from Golf Laboratories, Inc., and two points of a ball respectively were hit once at the head speed of 36 m/sec. to observe the areas which were hit. Abrasion-resistance was evaluated and ranked into six levels based on following criteria.

6: No scratch was identified.
5: Scratches were hardly present, or scratches were almost inconspicuous.
4: Slight scratches were present, but were almost unannoying.
3: The surface of the golf ball was somewhat scuffed.
2: The surface of the golf ball was scuffed and dimples were missing.
1: Dimples were scraped away completely.

(2) Spin Rate (rpm)

An approach wedge (SRIXON I-302, Shaft S) available from SRI Sports Limited was installed on a swing robot available from Golf Laboratories, Inc. and a golf ball was hit at a head speed of 21 m/second. The spin rate was measured by continuously taking photographs of the golf ball which had been hit. The measurement was carried out five times, and the average value of the result is shown.

(3) Slab Hardness of the Cover (Shore D Hardness)

A sheet having a thickness of about 2 mm was prepared using the cover composition by hot press molding, and the sheet was preserved at the temperature of 23° C. for two weeks. Three or more of the sheets were stacked on one another to avoid being affected by the measuring substrate on which the sheets were placed, and the stack was subjected to the measurement using P1 type automatic rubber hardness tester manufactured by Kobunshi Keiki Co., Ltd. equipped with Shore D type spring hardness tester prescribed by ASTM-D2240.

(4) Spherical Core (Center) Hardness

Shore D hardness obtained by measuring a center and a surface part of the spherical core using a P1-type automatic rubber hardness tester equipped with Shore D type spring hardness tester specified by ASTM-D2240 were determined as the center and the surface hardness of the spherical core respectively, and a hardness measured by cutting a spherical core into hemispherical shape to measure a center of a cut surface thereof was determined as the center hardness of the center (spherical core).

(5) Method for Measuring Content Ratio of Layered Silicate (TGA and Fluorescent X-ray Diffraction)

Using TGA2950 manufactured by TA Instruments., 10 mg of a cover composition was heated under a nitrogen atmosphere and under following conditions, and a change in weight after leaving at 650° C. for 1.5 minute with respect to a weight at 25° C. was determined, thereby obtaining a content ratio of an inorganic component in the cover composition.

Heating conditions: 25° C. to 650° C. (heating speed: 50° C./minute, leaving at 650° C. for 1.5 minute)

Simultaneously, a weight ratio of each element contained in the inorganic component in the cover composition (Ti, Si, Al, and other inorganic elements) is obtained from a X-ray diffraction peak of the cover composition, and a content of the layered silicate in the cover composition was calculated on the premise that Ti is attributed to titanium oxide ($TiO_2$), Si and Al to clay components, and other inorganic elements to other inorganic components.

X-ray diffraction was measured under the following conditions.

Name of device: SEA1200VX
Manufacturer: SII
X-ray source (X-ray tube target): rhodium (Rh)
Tube voltage: 50 kV, 15 kV
Tube current: automatic adjustment
Tube cooling type: air-cooling type
Detector: Si semiconductor detector
Analyzed area (a diameter of collimator): 8 mm
Temperature of the sample: room temperature (23° C.)
Sample chamber atmosphere: vacuum
Measuring range: 0 Kev to 40 keV (Measured element: 11 (Na) to 92(U))
Measuring time: 200 seconds (6) Interlayer Spacing of Urethane Polyol-Layered Silicate Composite by X-ray Diffraction An interlayer spacing (d) of the urethane polyol-layered silicate composite was obtained using X-ray diffraction device MXP3 manufactured by MAC Science.

X-ray source: CuKα ray (wavelength X=1.5418 Å)
Applied voltage: 40 kV
Applied current: 30 mA
Measuring range: 2θ=0.01° to 10°
Intake range: 0.01°
Calculation formula: 2d sin θ=λ=1.5418 Å (θ: a half value of an angle of the peak (2θ))

(7) Measurement of Particle Diameter of Urethane Polyol-Layered Silicate Composite by TEM Device: Transmission electron microscopy H7100 manufactured by Hitachi, Ltd.
Conditions for observation: accelerating voltage of 100 kV, magnification of 5000 times, visual field of 20μm×20 μm
Conditions for preparing sample:
Device: cryomicrotome EMUC6 manufactured by manufactured by Leica
Temperature for cutting out a section: sample at −130° C., knife at −140° C., atmosphere at −140° C.
Speed for cutting out a section: 1 mm/second
Predetermined thickness of a section cut out: 40 nm

[Synthesis of Urethane Polyol-Layered Silicate Composite]

(1) Synthesis of Urethane Polyol having Tertiary Amine Structure 53.6 g of hexamethylene diisocyanate (HDI) was put in a state of being stirred under dry nitrogen air flow at 30° C., and 19.0 g of N-methyl diethanolamine (MDEA) was dropped thereto as a polyol having a tertiary amine structure for 20 minutes followed by stirring for about two hours, thereby obtaining an isocyanate group-terminated MDEA. An end point of the reaction was judged by subjecting a reaction product to titration specified by JIS and confirming whether or not hexamethylene diisocyanate (HDI) was reacted in a theoretical amount. Next, as shown in Table 1, polyol and dibutyl tin dilaurylate (DBTDL) were blended and stirred at 65° C. under dry nitrogen air flow, and the isocyanate group-terminated MDEA was dropped thereto for 30 minutes followed by reacting for 30 minutes, thereby synthesizing the urethane polyol having the tertiary amine structure. An end point of the reaction was determined by confirming that a peak derived from an isocyanate group (about 2270 $cm^{-1}$) did not exist.

A composition of the urethane polyol having the tertiary amine structure is shown in Table 1

TABLE 1

| Urethane polyol having ternary amine structure | 1 | 2 | 3 |
|---|---|---|---|
| HDI | 53.6 | 53.6 | 53.6 |
| MDEA | 19.0 | 19.0 | 19.0 |
| PEG400 | 127.4 | — | — |
| PTMG1000 | — | 318.5 | — |
| PTMG2000 | — | — | 637 |
| DBTDL | 0.1 | 0.1 | 0.1 |

Unit: g
HDI: hexamethylene diisocyanate manufactured by Wako Pure Chemical Industries, Ltd.
PEG400: polyethylene glycol with a molecular weight of 400 manufactured by ALDRICH
PTMG1000: polytetramethylene ether glycol with a molecular weight of 1000 manufactured by Hodogaya Chemical Co., LTD.
PTMG2000: polytetramethylene ether glycol with a molecular weight of 2000 manufactured by Hodogaya Chemical Co., LTD.

(2) Cationization of Urethane Polyol having Tertiary Amine Structure

In the 300 g of the urethane polyol having the tertiary amine structure obtained above, 1000 g of a mixture of an ion-exchange water and an isopropyl alcohol (ion-exchange water:isopropyl alcohol=3:7 (volume ratio)) was added, and the temperature of the mixture was made 65° C., thereby preparing a dispersion liquid. In the urethane polyol dispersion liquid, 6N-HCl was dropped until pH of the dispersion liquid became 3 to cationize the tertiary amine structure, thereby obtaining a dispersion liquid of the cationized urethane polyol.

(3) Modifying the Layered Silicate with the Cationized Urethane Polyol for Preparing the Composite 35 g of Cloisite $Na^+$ (montmorillonite) is dispersed in 2.3 L of a mixture of an ion-exchange water and an isopropyl alcohol (ion-exchange water:isopropyl alcohol=4:6 (volume ratio)) as the layered silicate, thereby obtaining a dispersion liquid of the layered silicate. The dispersion liquid of the layered silicate was added to the dispersion liquid of the cationized urethane polyol, and the liquid was stirred at 65° C. for two days, thereby obtaining a dispersion liquid of an urethane polyol-layered silicate composite (Table 2).

After that, the dispersion liquid of the urethane polyol-layered silicate composite was repeatedly subjected to centrifugation and dispersed in the ion-exchange water to remove a free hydrochloric acid from the system. Whether or not the fee hydrochloric acid was removed from the system was judged by reacting a supernatant liquid of the dispersion liquid of the urethane polyol-layered silicate composite with a silver nitrate. If deposition of the silver chloride was recognized, it is judged that the free hydrochloric acid existed in the dispersion liquid of the urethane polyol-layered silicate composite, and the centrifugation and the dispersion to the ion-exchange water were repeated again. The resultant urethane polyol-layered silicate composite was freeze dried for one day, and the dried material was ground with mortar, and screened to obtain only the material having a size of 200 μm or less. Properties of the urethane polyol-layered silicate composite is shown in Table 2.

TABLE 2

| Urethane polyol-layered silicate composite | 1 | 2 | 3 |
|---|---|---|---|
| Urethane polyol having tertiary amine structure 1 (PEG 400) | 100 | — | — |
| Urethane polyol having tertiary amine structure 2 (PTMG 2000) | — | 195.9 | — |
| Urethane polyol having tertiary amine structure 3 (PTMG 2000) | — | — | 354.9 |
| Cloisite Na(g)/water (L) | 35/2.3 | 35/2.3 | 35/2.3 |
| Distance between layers (nm) | 2.7 | 5 | 9.4 |
| TEM particle diameter (μm) | 0.2~20 | 0.5~20 | 0.5~20 |

Unit: g

Cloisite $Na^+$: montmorillonite: cation exchange capacity 92.6 meq/100 g available from Southern Clay Products Inc.

(4) The powder-like urethane polyol-layered silicate composite was added in PTMG 1000, and the mixture was stirred at 65° C. for 1 hour followed by being subjected to ultrasonic treatment for one hour using The Vibra-Cell VC505 manufactured by Sonics & Materials, Inc., thereby dispersing the urethane polyol-layered silicate composite in the polyol. The resultant composition of the polyol dispersion liquid was shown in Table 3.

(5) Preparation of Cover Composition a) Use of 4,4'-diphenylmethane diisocyanate as polyisocyanate Under dry nitrogen air flow, 18 g of a polyol dispersion liquid of urethane polyol-layered silicate composite was heated to 65° C., and 19.0 g of 4,4'-diphenylmethane diisocyanate heated to 65° C. was added thereto and the mixture was stirred at 65° C. for 1 minute followed by cooling to about 40° C. After that, 4.9 g of butanediol at 40° C. was charged thereto and stirred at 45° C. for 30 seconds. The mixture was cooled to the room temperature and deaerated by reducing the pressure at the room temperature for 30 seconds. The resultant product was put in a container to carry out a urethane reaction by reacting the product under a nitrogen atmosphere at 80° C. for 1 hour, and continuously keeping the product at 110° C. for 6 hours. After finishing the urethane reaction, the resultant product was pulverized into the form of pellet, thereby obtaining a polyurethane resin composition wherein the layered silicate was composite-dispersed in the polyurethane resin.

b) Use of 4,4'-dicyclohexylmethane diisocyanate as polyisocyanate

Under dry nitrogen air flow, 19.6 g of 4,4'-dicyclohexylmethane diisocyanate and 0.002 g of dibutyl tin dilaurylate were charged into a flask and heated to 60° C. 18.0 g of polyol was dropped thereto for about 45 minutes using a dropping funnel, and after finishing the dropping, the mixture was heated at 60° C. for 2 hours for the reaction. Then, 4.9 g of butanediol at 60° C. was added and stirred for about 1 minute. The mixture was cooled to a room temperature and deaerated by reducing at room temperature for 30 seconds. The resultant product was put in a container to carry out a urethane reaction by keeping the product for 48 hours under nitrogen at 80° C. After finishing the urethane reaction, the resultant product was pulverized in the form of pellet, thereby obtaining a polyurethane resin composition wherein the layered silicate was composite-dispersed in a polyurethane resin.

[Preparation of Golf Ball]

(1) Preparation of Center

The rubber composition for the center shown in Table 4 was kneaded and pressed with upper and lower molds each having a spherical cavity at the heating condition of 170° C. for 15 minutes to obtain the center in a spherical shape having a diameter of 38.5 mm and a weight of 34.9 g.

TABLE 4

| Center composition | Part by mass |
|---|---|
| Polybutadiene rubber | 100 |
| Zinc acrylate | 35 |

TABLE 3

| Polyol dispesion liquid | 1 | 2 | 3 | 4 | 5 | 6 | 7 | 8 | 9 | 10 | 11 |
|---|---|---|---|---|---|---|---|---|---|---|---|
| Urethane polyol-layered silicate composite (PEG 400) | — | — | — | — | — | 2 | — | — | — | — | — |
| Urethane polyol-layered silicate composite 2 (PTMG 1000) | — | — | — | — | 2 | — | — | — | — | — | — |
| Urethane polyol-layered silicate composite 3 (PTMG 2000) | 0.5 | 1 | 2 | 10 | — | — | — | — | — | 0.1 | 15 |
| Cloisite Na | — | — | — | — | — | — | — | 1.07 | — | — | — |
| Cloisite 25A | — | — | — | — | — | — | — | — | 1.34 | — | — |
| PTMG1000 | 100 | 100 | 100 | 100 | 100 | 100 | 100 | 100 | 100 | 100 | 100 |

Formulation: parts by mass

Cloisite 25A: natural montmorillonite modified with quaternary ammonium salt, manufactured by Southern Clay Products Inc.

PTMG1000: polytetramethylene ether glycol molecular weight 1000 manufactured by Hodogaya Chemical Co., LTD.

TABLE 4-continued

| Center composition | Part by mass |
|---|---|
| Zinc oxide | 5.0 |
| Diphenyl disulfide | 0.5 |
| Dicumyl peroxide | 1 |
| Center hardness (Shore D) of center (core) | 40 |

Polybutadiene rubber: BR730 (high cis-polybutadiene) manufactured by JSR

Zinc acrylate: ZNDA-90S manufactured by NIHON JYORYU KOGYO Co,. LTD.

Zinc oxide: "Ginrei R" produced by Toho-Zinc Co.

Dicumyl peroxide: Percumyl D manufactured by NOF Corporation

Diphenyl disulfide: manufactured by Sumitomo Seika Chemicals Company Limited (2) Composition of Intermediate Layer Material and Cover Composition Next, an intermediate layer material and a cover composition shown in Tables 5 and 6 were mixed by a twin-screw kneading extruder, thereby preparing an intermediate layer material and a cover composition in the form of pellet. Extrusion was carried out in the following conditions: screw diameter=45 mm, screw revolutions=200 rpm, screw L/D=35, and the mixture was heated to from 150 to 230 at the die position of the extruder.

TABLE 5

| Intermediate layer composition | Part by mass |
|---|---|
| Himilan 1605 | 50 |
| Himilan AM7329 | 50 |

TABLE 5-continued

| Intermediate layer composition | Part by mass |
|---|---|
| Slab hardness (shore D hardness) of intermediate layer | 64 |

"Himilan 1605": Sodium ion-neutralized ethylene-methacrylic acid copolymer ionomer resin manufactured by MITSUI-DUPONT POLYCHEMICAL.
"Himilan AM7329": Zinc ion-neutralized ethylene-methacrylic acid copolymer ionomer resin manufactured by MITSUI-DUPONT POLYCHEMICAL.

The resultant material for the intermediate layer was injection molded onto the center thus obtained to prepare a core having a center and an intermediate layer (thickness of 1.6 mm) covering the center.

(3) Molding of Half Shell

The half shells were compression-molded by charging the cover composition in the form of the pellet obtained as described above into each of the depressed parts of the lower molds, and applying pressure to mold half shells. The compression-molding was carried out under the pressure of 2.94 MPa, at the temperature of 180° C. for 5 minutes in the case of MDI polyurethane resin, and at the temperature of 160° C. for 5 minutes in the case of $H_{12}$MDI polyurethane resin.

(4) Cover Formation

The core obtained in (2) is covered with two half shell obtained in (3) in a concentric manner, thereby molding a cover (thickness 0.5 mm) by compression molding. The compression molding was performed under conditions of: molding temperature at 150° C., molding time for 2 minutes and a molding pressure at 9.8 MPa.

A surface of the resultant golf ball body is subjected to sandblast treatment and marking, and then coated with a clear paint, and the paint was dried in an oven at 40° C., thereby obtaining a golf ball having a diameter of 42.7 mm and a mass of 45.3 g. Abrasion-resistance, and spin performance were evaluated with respect to the resultant golf ball, and the results are shown in Table 6.

TABLE 6

| | Golf ball | | | | | | |
|---|---|---|---|---|---|---|---|
| | 1 | 2 | 3 | 4 | 5 | 6 | 7 |
| Cover composition | — | — | — | — | — | — | — |
| Polyol dispersion liquid 1 (PTMG 2000) | 43 | — | — | — | — | — | — |
| Polyol dispersion liquid 2 (PTMG 2000) | — | 43 | — | — | — | — | — |
| Polyol dispersion liquid 3 (PTMG 2000) | — | — | 43 | — | — | 42.4 | — |
| Polyol dispersion liquid 4 (PTMG 2000) | — | — | — | 43 | — | — | — |
| Polyol dispersion liquid 5 (PTMG 1000) | — | — | — | — | 43 | — | — |
| Polyol dispersion liquid 6 (PEG400) | — | — | — | — | — | — | 43 |
| Polyol dispersion liquid 7 | — | — | — | — | — | — | — |
| Polyol dispersion liquid 8 | — | — | — | — | — | — | — |
| Polyol dispersion liquid 9 | — | — | — | — | — | — | — |
| Polyol dispersion liquid 10 (PTMG 2000) | — | — | — | — | — | — | — |
| Polyol dispersion liquid 11 (PTMG 2000) | — | — | — | — | — | — | — |
| MDI | 45.3 | 45.3 | 45.3 | 45.3 | 45.3 | — | 45.3 |
| $H_{12}$MDI | — | — | — | — | — | 46.1 | — |
| BD | 11.7 | 11.7 | 11.7 | 11.7 | 11.7 | 11.5 | 11.7 |
| ELASTOLLAN 1195ATR | — | — | — | — | — | — | — |
| Urethane polyol-layered silicate composite 3 | — | — | — | — | — | — | — |
| Titanium oxide | 3 | 3 | 3 | 3 | 3 | 3 | 3 |
| Distance between layers of Urethane polyol-layered silicate composite (nm) | 9.4 | 9.4 | 9.4 | 9.4 | 5 | 9.4 | 2.7 |
| Slab hardness (shore D) | 47 | 47 | 47 | 47 | 47 | 47 | 47 |
| Properties | — | — | — | — | — | — | — |
| Content of layred silicate in the cover (mass %) | 0.25 | 0.5 | 1 | 5 | 1 | 1 | 1 |
| Abrasion-resistance | 4 | 4.5 | 5 | 3 | 4 | 6 | 4 |
| Amount of spin (rpm) | 6700 | 6800 | 6800 | 6800 | 6800 | 6700 | 6400 |

TABLE 6-continued

| | Golf ball | | | | | | |
|---|---|---|---|---|---|---|---|
| | 8 | 9 | 10 | 11 | 12 | 13 | 14 |
| Cover composition | — | — | — | — | — | — | — |
| Polyol dispersion liquid 1 (PTMG 2000) | — | — | — | — | — | — | — |
| Polyol dispersion liquid 2 (PTMG 2000) | — | — | — | — | — | — | — |
| Polyol dispersion liquid 3 (PTMG 2000) | — | — | — | — | — | — | — |
| Polyol dispersion liquid 4 (PTMG 2000) | — | — | — | — | — | — | — |
| Polyol dispersion liquid 5 (PTMG 1000) | — | — | — | — | — | — | — |
| Polyol dispersion liquid 6 (PEG400) | — | — | — | — | — | — | — |
| Polyol dispersion liquid 7 | 42.4 | 43 | — | — | — | — | — |
| Polyol dispersion liquid 8 | — | — | 43 | — | — | — | — |
| Polyol dispersion liquid 9 | — | — | — | 43 | — | — | — |
| Polyol dispersion liquid 10 (PTMG 2000) | — | — | — | — | 43 | — | — |
| Polyol dispersion liquid 11 (PTMG 2000) | — | — | — | — | — | 43 | — |
| MDI | — | 45.3 | 45.3 | 45.3 | 45.3 | 45.3 | — |
| $H_{12}$MDI | 46.1 | — | — | — | — | — | — |
| BD | 11.5 | 11.7 | 11.7 | 11.7 | 11.7 | 11.7 | — |
| ELASTOLLAN 1195ATR | — | — | — | — | — | — | 100 |
| Urethane polyol-layered silicate composite 3 | — | — | — | — | — | — | 2 |
| Titanium oxide | 3 | 3 | 3 | 3 | 3 | 3 | 3 |
| Distance between layers of Urethane polyol-layered silicate composite (nm) | — | — | 1.2 | 2.1 | 9.4 | 9.4 | 9.4 |
| Slab hardness (shore D) | 47 | 47 | 47 | 47 | 47 | 47 | 47 |
| Properties | — | — | — | — | — | — | — |
| Content of layred silicate in the cover (mass %) | 0 | 0 | 1 | 1 | 0.05 | 7.5 | 1 |
| Abrasion-resistance | 3 | 2 | 1 | 1 | 2 | 1 | 1 |
| Amount of spin (rpm) | 6300 | 6400 | 6200 | 6200 | 6400 | 6000 | 6200 |

Formulation: parts by mass
ELASTOLLAN 1195 ATR: MDI thermoplastic polyurethane manufactured by BASF Japan From Table 6, it is clear that the golf ball having a core and a cover covering the core, wherein the cover contains the layered silicate and the polyurethane resin having the tertiary amine structure in a molecular chain thereof and a content of the layered silicate in the cover is from 0.1 to 5 mass %, is excellent in the abrasion-resistance and has a high spin rate at the time of approach shot.

The golf ball of the present invention is excellent in abrasion-resistance, and is useful as a golf ball with a high spin rate at the time of approach shot.

This application is based on Japanese Patent application No. 2007-138441 filed on May 24, 2007, the contents of which are hereby incorporated by reference.

What is claimed is:

1. A golf ball comprising
a core, and
a cover covering the core,
wherein the cover comprises
a polyurethane resin having a secondary or tertiary amine structure in a molecular chain thereof, and
a layered silicate having an interlayer spacing of at least 5 nm measured by X-ray diffraction, or a X-ray diffraction peak attributed to the layered silicate is not detected.

2. The golf ball according to claim 1, wherein the secondary or tertiary amine structure is cationized and bonded to the layered silicate via electrostatic interaction.

3. The golf ball according to claim 1, wherein a content of the layered silicate contained in the cover is ranging from 0.05% to 7.5% by mass.

4. The golf ball according to claim 1, wherein the cover is formed from a cover composition which comprises
a polyisocyanate,
a polyol, and
a polyol-layered silicate composite treated with a polyol having a secondary or tertiary amine structure in a molecule thereof.

5. The golf ball according to claim 4, wherein the polyol-layered silicate composite is such that the polyol having the secondary or the tertiary amine structure is cationized at the portion of the secondary or tertiary amine structure and bonded to the layered silicate via electrostatic interaction.

6. The golf ball according to claims 4, wherein the polyol-layered silicate composite treated with the polyol having the secondary or tertiary amine structure is a urethane polyol-layered silicate composite treated with a urethane polyol having a secondary or tertiary amine structure.

7. The golf ball according to claim 4, wherein the polyol-layered silicate composite comprises N-methyl diethanol amine or N-isobutyl diethanol amine as a polyol component.

8. The golf ball according to claim 1, wherein the layered silicate is at least one selected from the smectite group consisting of montmorillonite, beidellite, nontronite, saponite, iron saponite, hectorite, sauconite, and stevensite.

9. The golf ball according to claim 1, wherein the layered silicate is at least one selected from the vermiculite group consisting of dioctahedral vermiculite, and trioctahedral vermiculite.

10. A golf ball comprising
a core, and
a cover covering the core,
wherein the cover is formed from a cover composition which comprises
a polyisocyanate,
a polyol, and
a urethane polyol-layered silicate composite treated with a urethane polyol having a secondary or tertiary amine structure in a molecule thereof, and
the urethane polyol-layered silicate composite is such that the urethane polyol having the secondary or the tertiary amine structure is cationized at the portion of the secondary or tertiary amine structure, bonded to the layered silicate via electrostatic interaction, and has an interlayer spacing of at least 5 nm measured by X-ray diffraction, or a X-ray diffraction peak attributed to the layered silicate is not detected.

11. The golf ball according to claim 10, wherein a content of the layered silicate contained in the cover is ranging from 0.05% to 5% by mass.

12. The golf ball according to claim 11, wherein the urethane polyol-layered silicate composite comprises polytetramethylene ether glycol as a polyol component.

13. The golf ball according to claim 11, wherein the urethane polyol-layered silicate composite comprises N-methyldiethanol amine or N-isobutyl diethanol amine as a polyol component.

14. The golf ball according to claim 10, wherein the layered silicate is at least one selected from the smectite group consisting of montmorillonite, beidellite, nontronite, saponite, iron saponite, hectorite, sauconite, and stevensite.

15. The golf ball according to claim 10, wherein the layered silicate is at least one selected from the vermiculite group consisting of dioctahedral vermiculite, and trioctahedral vermiculite.

16. A process for producing a golf ball comprising the steps of:

cationizing a polyol having a secondary or tertiary amine structure in a molecule thereof, dispersing a layered silicate into the cationized polyol to obtain a polyol-layered silicate composite having an interlayer spacing of at least 5 nm measured by X-ray diffraction, or a X-ray diffraction peak attributed to the layered silicate is not detected, mixing the polyol-layered silicate composite, a polyol, and a polyisocyanate to prepare a cover composition, and molding a cover from the cover composition.

17. The process for producing the golf ball according to claim 16, wherein the polyol is cationized by neutralizing the polyol having the secondary or tertiary amine structure in the molecule thereof with an acid.

18. The process for producing the golf ball according to claim 16, the cover composition is prepared by dispersing the polyol-layered silicate composite into the polyol, subjecting a mixture thereof to ultrasonic treatment, and subsequently mixing the mixture with the polyisocyanate.

19. The process for producing the golf ball according to claim 16, wherein a urethane polyol-layered silicate composite treated with a urethane polyol having a secondary or tertiary amine structure is used as the polyol-layered silicate composite treated with the polyol having the secondary or tertiary amine structure.

* * * * *